United States Patent [19]

Hoyt

[11] Patent Number: 4,487,147

[45] Date of Patent: Dec. 11, 1984

[54] CONTINUOUS REEFING SYSTEM

[76] Inventor: John G. Hoyt, 49 America's Cup Ave., Newport, R.I. 02840

[21] Appl. No.: 528,139

[22] Filed: Aug. 31, 1983

[51] Int. Cl.[3] ..... B63H 9/10

[52] U.S. Cl. ..... 114/104; 114/105

[58] Field of Search ..... 114/103, 104, 105, 111, 114/114, 102

[56] References Cited

U.S. PATENT DOCUMENTS

| | | | |
|---|---|---|---|
| 26,857 | 1/1860 | Morton | 114/105 |
| 235,868 | 12/1880 | Gondie | 114/105 |
| 471,847 | 3/1892 | Newcomb et al. | 114/105 |
| 3,084,656 | 4/1963 | Johnson | 114/105 |

*Primary Examiner*—Sherman D. Basinger
*Assistant Examiner*—C. T. Bartz
*Attorney, Agent, or Firm*—Barlow & Barlow, Ltd.

[57] ABSTRACT

A sail is reefed by a single continuous reefing line which passes from the boom through a leech cringle then down parallel to the boom and then upwardly through a block affixed to a luff cringle. The reefing line then leads through a turning block near the gooseneck of the boom so that when a downward pull is placed on the line and the halyard is simultaneously released, the luff will first be moved downwardly to the foot of the sail and then the leech will be moved downwardly creating a reef.

3 Claims, 3 Drawing Figures

CONTINUOUS REEFING SYSTEM

BACKGROUND OF THE INVENTION

In the conventional form of reefing, a number of reef points were provided across the sail extending from a luff cringle to a leech cringle and when it was desired to execute the reef, individual effort was required to lower the sail, maintain the same in a luff condition, attach the tack cringle to the forward end of the boom near the gooseneck, then attach the leech cringle in a similar fastion, and tie all the reef points around the foot of the sail. This typical maneuver required the use of a number of deck hands and spoiled the shape of the sail so that the vessel lost speed through the water. Modern offshore racing yachts have been utilizing a quick reefing system also known as California Reefing, Slab Reefing, or Jiffy Reefing. Where the halyard is released, the reef tack downhaul is tightened until the luff cringle is drawn down to the gooseneck where it is either fastened by cleating the reef tack downhaul or hooking the cringle onto a gooseneck. The main halyard is then tightened up and the clew cringle line is pulled downwardly toward the foot of the sail and the boom with a sheet being slightly released to allow the boom to assume a new position relative to the sail. With this type of maneuver, only two men are needed, one on the halyard and one on the reefing lines, and the reef can be executed within 30 seconds with a very minimum loss of speed at the time when the sheet must be released in order to adjust the leech into its new position.

The number of lines about the mast of any sailboat become numerous with any system and it is desirous, therefore, to reduce the number of lines to a minimum so that a need for improvement of the reefing systems in indicated.

In the past suggestions for this type of arrangement are seen in patents such as Martin, U.S. Pat. No. 26,915 of 1860, where a plurality of sheaves are provided along the boom and individual reefing lines that extend through reefing cringles in the sail, pass around the sheaves and then are long spliced into a single line that may then pass around a drum of a winch. This system, however, leaves something to be desired as there is no provision for maintaining an outhaul at the clew of the sail nor proper positioning of the tack, and while it is perfectly satisfactory in a gaff rigged arrangement such as illustrated in Martin, same is not appropriate for a modern racing Marconi rigged vessel. Several other examples of similar arrangements are seen in U.S. Pat. Nos. 26,857; 235,868; 315,501; and 417,324.

Summary of the Invention

According to the invention, an arrangement for reefing a sail is provided where a single continuous reefing line is first secured near the end of the boom on which the sail foot is detachably secured, which line may thence lead upwardly to a leech reefing cringle, thence downwardly through a turning block preferably in the end of the boom or near the end thereof. The line may then travel inside the boom, exiting through an exit block and thence lead upwardly to a luff block secured to a luff cringle. The reefing line then passes downwardly again through a turning block at the gooseneck of the boom. From there it may lead through a deck turning block aft to the cockpit or in any other fashion suitable to the size and type of vessel on which the invention is supplied.

DESCRIPTION OF THE PREFERRED EMBODIMENT

Figure 1:
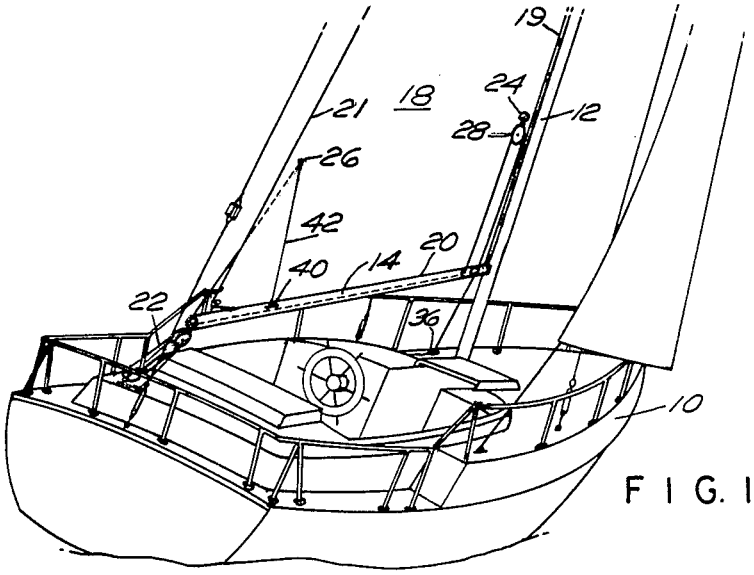
FIG. 1 is a perspective view of a sailing vessel utilizing the reefing rig of my invention.

FIG. 1 shows a conventional sloop rigged sailboat fitted with the reefing system of the invention. A sailboat includes a hull 10, on which is mounted a vertical mast 12 and has a boom 14 affixed to the mast by a gooseneck fitting 16. On the boom and mast, a mainsail 18 is detachably secured as by means of a track and sliders or by foot and luff ropes and grooves. For identification purposes, the luff of the sail is indicated at 19 while the foot of the sail is indicated at 20 and the leech is indicated as at 21. The boom is suitably trimmed by a main sheet 22.

The reefing system of the instant invention is achieved by providing a luff cringle 24 and a leech cringle 26 in the mainsail 18, both of which are suitably spaced above the foot of the sail, a proper distance to maintain the proper sail shape when they are brought downwardly to the foot of the sail. At the luff cringle 24, a block 28 is fastened, and on the boom 14, there is provided a turning block 30 found just aft of the gooseneck 16. Also, on the end of the boom there is located a turning block 32 and a further turning block is mounted at the gooseneck designated 34 while at the deck level there may be provided a further turning block 36. A continuous reefing line is first affixed to a point near the end of the boom as at 40 either by fastening the line about the boom or using a padeye and thence the reefing line is led up through the leech cringle 26 and then down about the turning block 32 where the line is illustrated as passing through the interior of the boom 14. Alternately, of course, it should be understood that the turning block 32 could be replaced by a cheek block and the line passed along the outside of the boom 14. The reefing line than passes around the turning block 30, which could be a cheek block as well as an exit block as illustrated, and then through block 28 located on the luff cringle from whence the reefing line leads downwardly about the turning block 34. The line may then pass about the deck block 36, so that the line may lead aft to the cockpit for the convenience of the crew, where the main halyard may also be located.

Figure 2:
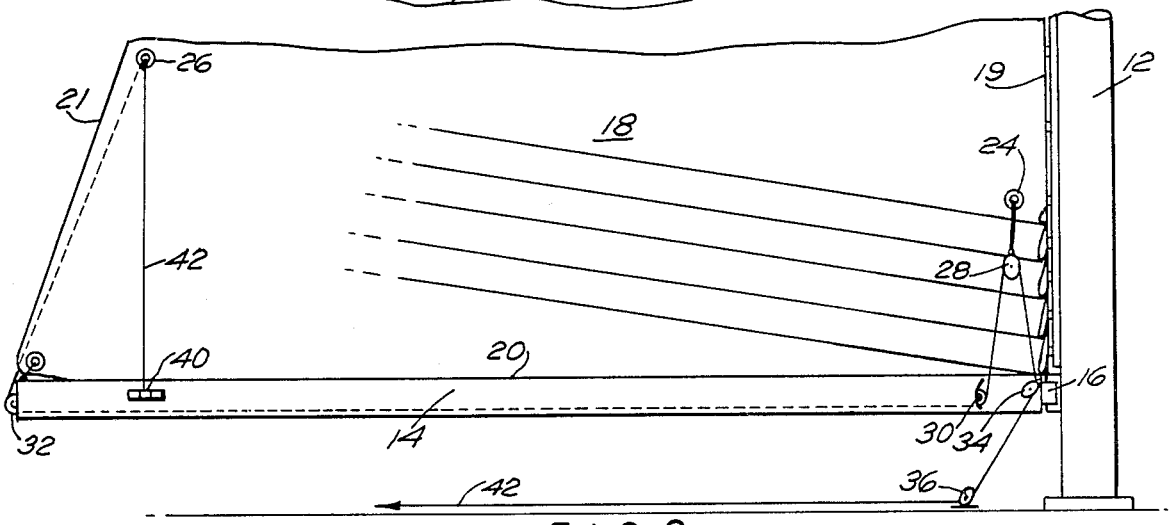
FIG. 2 is a partial elevational view showing the reefing system in its initial stages of being operated.
Figure 3:
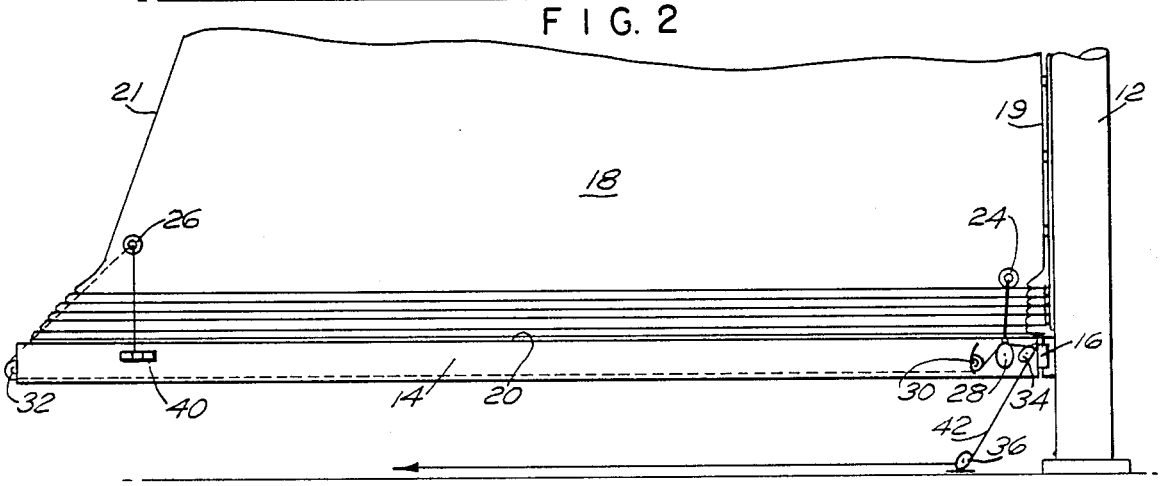
FIG. 3 is a partial elevational view showing the reefing completed, the reefed sail being exaggerated for clarity.

To achieve a reef, the halyard is released and the reefing line is pulled at the same time, which pulls down the luff of the sail that is shown as being partially pulled down in FIG. 2 of the drawings. When the luff is pulled all the way down as tight as it will go, the halyard may now be temporarily fastened and continuous pull on the reefing line will pull the clew cringle down towards the foot of the sail as illustrated in FIG. 3. As this latter operation is being achieved, the sheet should be slacked slightly to allow the leech cringle to be pulled down as tightly as possible. The arrangement is shown in FIG. 3 is not completely accurate, as it is meant to be more illustrative, for in actual practice, the luff and clew cringles will approach much closer to the foot of the sail or the boom.

In essence, therefore, it will be seen that a simpler system has been provided than any of the quick reefing systems heretofor known by the prevision of a single reefing line and the use of a luff cringle block.

I claim:

1. A sail having a foot, tack and leech detachably secured to a mast and boom:

(a) a leech cringle spaced away from the clew of the sail, (b) a luff cringle spaced away from the tack of the sail, (c) a luff block secured to the luff cringle, (d) a turning block secured to the boom near the gooseneck, (e) a continuous reefing line attached to the free end of the boom said reefing line leading through the leech cringle, thence parallel to the longitudinal extent of the boom, through the luff block and exiting from the turning block.

2. A said as in claim 1 wherein a sheave is provided on the free end of the boom and the reefing line leads from the leech cringle through the sheave, and the boom is provided with an aperture near the gooseneck end thereof where the reefing line may exit through an exit block.

3. The method of furling a sail comprising:

(a) providing reefing cringles at the leach and luff of the sail, (b) positioning a block at the luff cringle, (c) leading a continuous reefing line from the free end of the boom through the leech cringle thence by suitable means, leading the line parallel to the longitudinal extent of the boom, then leading the line through the block at the luff cringle, and thence downwardly toward the base of the mast whereby exerting a force on the reefing line and simultaneously letting off the halyard of the sail will pull down the luff cringle so that the same is adjacent to the foot of the sail and continuous force on the reefing line will then pull the leech cringle downwardly toward the foot of the sail so that the area of the sail is reduced and a reef is created.

* * * * *